US006701933B2

(12) United States Patent
Heitmann

(10) Patent No.: US 6,701,933 B2
(45) Date of Patent: Mar. 9, 2004

(54) APPARATUS FOR MAKING A STREAM OF TOBACCO SHREDS

(75) Inventor: Uwe Heitmann, Hamburg (DE)

(73) Assignee: Hauni Maschinenbau AG, Hamburg (DE)

( * ) Notice: Subject to any disclaimer, the term of this patent is extended or adjusted under 35 U.S.C. 154(b) by 3 days.

(21) Appl. No.: 09/482,679

(22) Filed: Jan. 14, 2000

(65) Prior Publication Data

US 2002/0162561 A1 Nov. 7, 2002

(30) Foreign Application Priority Data

Jan. 14, 1999 (DE) ..... 199 01 087

(51) Int. Cl.[7] ..... A24C 5/13; A24C 5/39
(52) U.S. Cl. ..... 131/84.1; 131/34.3; 131/108
(58) Field of Search ..... 131/108, 84.1, 131/109.2, 110, 84.4, 282, 84.3, 287; 198/370.4; 406/88, 94, 95; 241/41

(56) References Cited

U.S. PATENT DOCUMENTS 4,185,644 A 1/1980 Heitmann et al.
4,306,358 A * 12/1981 King, Jr. ..... 34/487
4,564,027 A * 1/1986 Heitmann ..... 131/108
5,148,816 A * 9/1992 Heitmann ..... 131/84.3
5,941,520 A * 8/1999 Stephan et al. ..... 271/195
5,967,146 A * 10/1999 Orihara et al. ..... 131/84.3
6,371,125 B1 * 4/2002 Schmidt ..... 131/109.2

FOREIGN PATENT DOCUMENTS

DE 4113465 * 10/1992
EP 0649605 * 10/1994

* cited by examiner

*Primary Examiner*—Steven P. Griffin
*Assistant Examiner*—Carlos Lopez
(74) *Attorney, Agent, or Firm*—Venable LLP; Robert Kinberg; Chad C. Anderson

(57) ABSTRACT

A device for creating a spread-out stream of tobacco fibers includes a concave-curved guide track along which the fiber stream of tobacco fibers are conveyed. The guide track has a generatrix based on a uniform generating curve. At least one air jet has an air flow opening interrupting the guide track so that air exiting the air flow jet acts in a conveyance direction of the fiber stream for spreading out the tobacco fibers.

10 Claims, 2 Drawing Sheets

APPARATUS FOR MAKING A STREAM OF TOBACCO SHREDS

CROSS-REFERENCE TO RELATED APPLICATIONS

Priority is claimed with respect to German application No. 199 01 087.0 filed in Germany on Jan. 14, 1999, the disclosure of which is incorporated herein by reference.

FIELD OF THE INVENTION

The invention relates to a device for creating a spread-out fiber stream of tobacco fibers along a concave-curved guide track provided with air flow openings acting in the transport direction of the fiber stream.

BACKGROUND OF THE INVENTION

A guide track of the type mentioned at the outset is part of a so-called distributor of a cigarette string machine. The guide track, together with an essentially parallel directed air flow, constitutes a so-called moving bed. Tobacco in the form of a loosened and spread-out tobacco stream is moved along close to the guide track and transferred to a suction string conveyor which forms the tobacco fibers into a tobacco string.

SUMMARY OF THE INVENTION

An object of the invention is to optimize the effectiveness, or respectively the conveying capacity, of the moving bed in respect to the energy outlay for the air flow supplied.

Moreover, it is an object to improve the guide track constituting the moving bed in respect to its construction, handling and exchangeability, or respectively installation and removal.

The above and other objects are accomplished in accordance with the invention by the provision of a device for creating a spread-out stream of tobacco fibers, comprising: a concave-curved guide track along which the fiber stream of tobacco fibers are conveyed, the guide track having a generatrix based on a uniform generating curve; and at least one air jet having an air flow opening interrupting the guide track so that air exiting the air flow jet acts in a conveyance direction of the fiber stream for spreading out the tobacco fibers.

Thus, in accordance with the invention the generatrix of the guide track, which is interrupted by the air flow openings designed as air jets, is based on a uniform generating curve.

For optimizing the conveying and spreading effect it is another aspect of the invention that the air jets terminating in the sliding surface of the guide track extend continuously over the width of the guide track.

In accordance with an advantageous embodiment, a close-lying wall flow (Coanda effect) is achieved in that the downstream wall of the air jet, in relation to the conveying direction of the fiber stream, makes a transition in the form of a continuous convex curve into the concave sliding surface of the guide track.

According to a further feature of the invention, the sliding surface of the guide track is interrupted by several air jets, which follow each other in the conveying direction of the fiber stream, which increases and complements the conveyance by the moving bed.

Preferably, the air jets are connected to a common pressure chamber.

In accordance with a preferred embodiment, the guide track is put together from individual segments, whose respectively adjoining border surfaces form nozzle walls of the air jets. In this way it is possible to design and assemble the guide track flexibly, or respectively to replace it in partial areas when it is worn, wherein an optimal orientation of sliding surface walls and air jets is always assured.

The advantageous effects of the construction of the guide track in segments are further increased by a production-specific further development, in that the guide track segments are embodied as extruded sections, whose wall sections defining the sliding surface of the guide track form an upstream and a downstream located nozzle wall, in respect to the conveying direction of the fiber stream, on two successive air jets.

The invention presents the advantage that, because of the continuous transition along the sections of the guide track which are interrupted by an air jet, the tobacco meets the air flow directly at the outlet of the air nozzle, i.e. at a location at which the air flow still has its maximum flow speed and can accelerate the tobacco fibers accordingly. In this way it is possible to operate the air supply at a low air pressure, or respectively with a respectively reduced blower output, which improves the effectiveness and the economy of the energy generation and the energy output.

Furthermore, an economical production-related advantage results from the use of individual segments, which are put together to form a guide track, whose simple exterior contours actually predestine them for being manufactured by means of the efficient extrusion process.

The invention will be explained in greater detail in what follows by means of an exemplary embodiment represented in the drawings.

DETAILED DESCRIPTION OF THE PREFERRED EMBODIMENT

Figure 1:
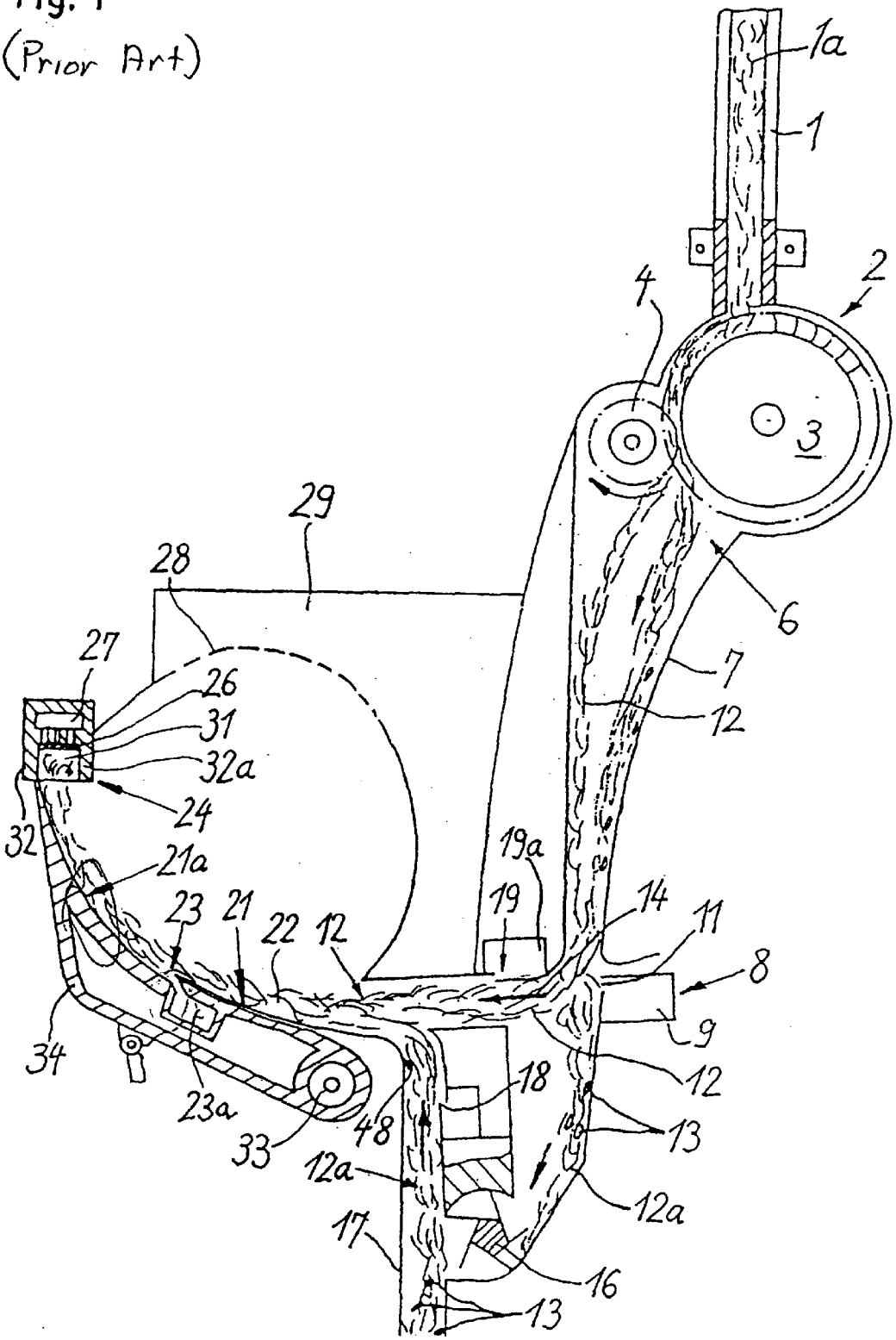
Fig. 1 (Prior Art)
FIG. 1 is a schematic longitudinal section through a distributor of a cigarette string machine.

FIG. 1 is a section through that portion of a distributor of a cigarette string machine which is required for understanding the invention. A variety of ways are known for the upstream located tobacco delivery to a reservoir and the removal of the tobacco from the tobacco reservoir, for example by means of a steep conveyor, and need not be described here. Reference is made, by way of example, to U.S. Pat. No. 4,185,644, which is incorporated herein by reference.

FIG. 1 shows a retaining chute 1 with a tobacco supply 1*a* and a removal device 2 consisting of a removal roller 3 and a beater roller 4. A batch 6 of tobacco fibers taken out of retaining chute 1 by removal device 2 reaches a delivery chute 7, which narrows funnel-like into the shape of a conduit, in which an acceleration means 8, which constitutes a pre-sifter in the form of air jets 11 arranged in a pressure chamber 9, blows a sifting air flow transversely in respect to the conveying direction of tobacco batch 6. The sifting air flow separates light tobacco fibers 12 from heavier tobacco fibers 13 (tobacco ribs) and conveys the light tobacco fibers away transversely in the direction of arrow 14.

Some of the light tobacco fibers 12*a* drop downwardly along with the heavier tobacco ribs 13. Through a cellular wheel sluice 16 they reach a sifting chute 17, in which the heavier tobacco ribs 13 drop further down and are removed. The lighter tobacco fibers 12*a* rise upwardly under an injection effect of an air flow out of a nozzle 18 constituting a post-sifter, and are returned into the stream of the lighter fibers 12. In the illustrated example, the tobacco fibers 12 and 12*a* are transferred with the aid of further air nozzles 19 of a pressure chamber 19*a* onto a guide track 21 in the form of a sliding surface 21*a*. There the tobacco fibers are built up into a tobacco stream 22 of loosened and spread-out tobacco fibers, wherein the air flow and the tobacco particles form a wall flow moving closely along the sliding surface 21*a* of the guide track 21. To aid in the continued conveyance of the spread-out and loosened tobacco stream 22 along guide track 21, air flow nozzles 23 supplied with air from a pressure chamber 23*a*, and further air flow nozzles (not shown) arranged in the course of the guide track 21 are provided.

The loosened and spread-out tobacco stream 22 reaches a suction strip conveyor 26 in a strip build-up zone 24, to which a suction draft for forming and maintaining a tobacco string is applied from the direction of the back by the suction effect of an under pressure chamber 27. Excess air flow escapes through a screen 28 into an expansion chamber 29.

The suction strip conveyor 26 rotates in a tobacco conduit 31, which is laterally bordered by two conduit cheeks 32 and 32*a*. The end section of sliding surface 21*a* of guide track 21 is oriented on one of the conduit cheeks 32, so that a gap-free smooth transition of guide track 21 into tobacco conduit 31 is assured.

The end section of the guide track 21 comprises a guide body 34, which can be pivoted away on a pivot axis 33 in order to assure better access to the device in case of malfunctions.

Figure 2:
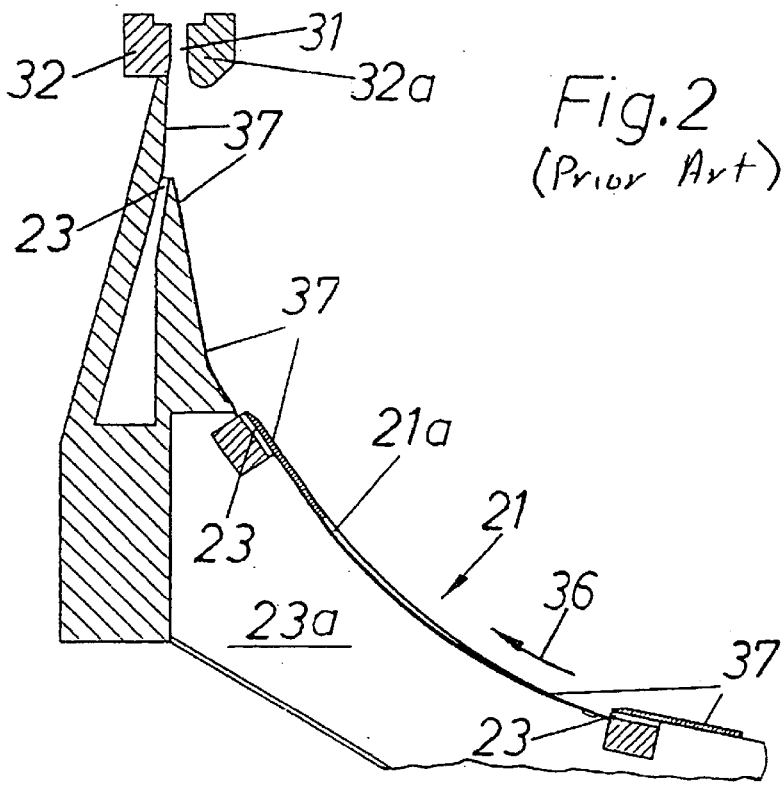
Fig.2 (Prior Art)
FIG. 2 is an enlarged section of the distributor with a conventional guide track for the tobacco.

FIG. 2 illustrates a conventional guide track 21 wherein sliding surfacc 21*a* consists of sliding plates, or respectively sliding bodies 37, set off in steps in the conveying direction (arrow 36) of the tobacco stream. As can be seen, air flow nozzles 23 terminate on the respective steps in guide track 21. This known construction has the result that in the area of a step, between two sliding plates, the tobacco stream meets the air flow coming from the air flow nozzles only at the end of a relatively long free trajectory, where the air flow has already lost approximately two-thirds of its exit velocity. In order to accelerate the tobacco stream to a predetermined value, the flow speed of the air flow must therefore be increased by an increase in the blower output, which negatively affects the overall power economy of the system.

Figure 3:
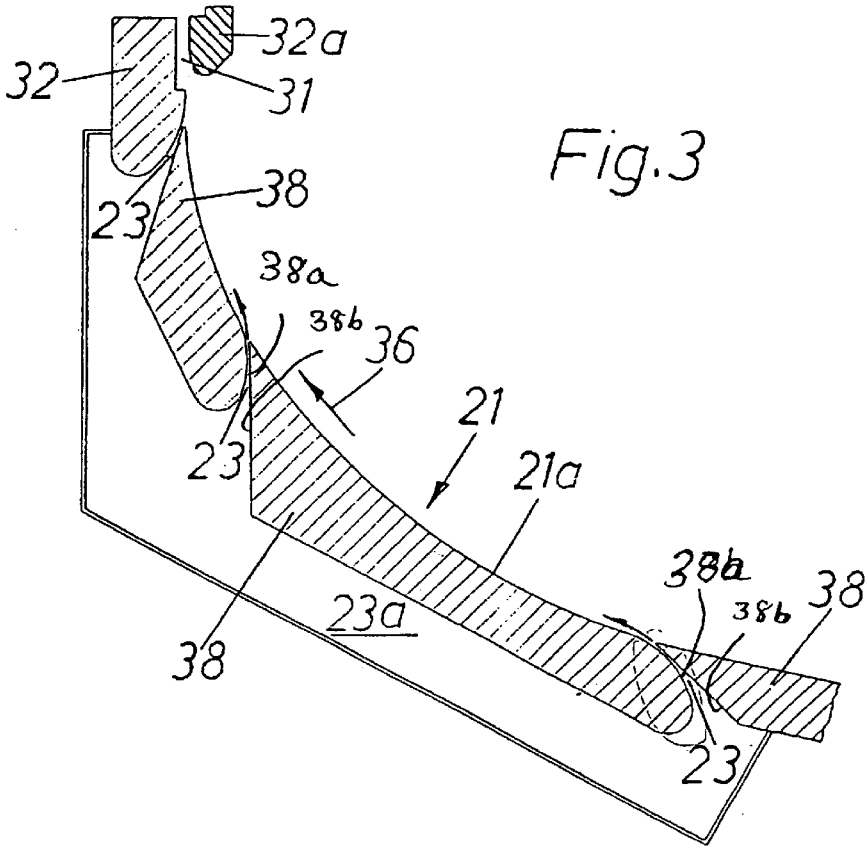
FIG. 3 is a guide track of the distributor embodied in accordance with the invention.

Referring to FIG. 3, there is shown an arrangement in accordance with the invention. In FIG. 3 the generatrix of the guide track 21, or more accurately, the guide surface 21*a*, is based on a uniform generating curve, so that individual segments 38 of the guide track adjoin each other continuously. Air flow nozzles 23, designed as air jets extending vertically in respect to the drawing plan, are formed at the respective joints of the individual segments 38, whose downstream wall 38*a*, in relation to the conveying direction (arrow 36) of the fiber stream, makes a transition into the concave sliding surface 21*a* of the guide track 21 in a steady convex curvature, so that an unbroken continuous wall flow of blown air and tobacco is formed on sliding surface 21. Individual segments 38 have an upstream wall 38*b*, in relation to the conveying direction, which forms the opposing wall of each flow nozzle or air jet 23. The tobacco stream and the air flow meet directly in the area of the outlet openings of the air jets, so that the air flow meets the tobacco stream at its maximum outflow velocity at each air jet.

The individual segments 38 are produced as extruded sections, whose respectively adjoining border surfaces always assure optimal flow conditions.

The invention has been described in detail with respect to referred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A device for creating a spread-out stream of tobacco fibers, comprising:

a concave-curved guide track along which the fiber stream of tobacco fibers are conveyed, the guide track having a generatrix based on a uniform curve, a portion of the concave-curved guide track being formed by a convex sliding surface, the guide track having a width; and at least one air nozzle having an air flow interrupting the guide track so that air exiting the nozzle acts in a conveyance direction of the fiber stream for spreading cut the tobacco fibers, wherein the nozzle has a downstream wall, in relation to the conveyance direction of the fiber stream, which makes a transition into the guide track in a steady convex curvature, the at least one nozzle terminating in the sliding and extending continuously over the width of the guide track.

2. The device in accordance with claim 1, wherein the at least one nozzle comprises a plurality of nozzles following each other in the conveying direction of the fiber stream and that interrupt the sliding surface.

3. The device in accordance with claim 2, wherein the guide track comprises a plurality of individual guide track segments having respectively adjoining border surfaces that form nozzle walls of the nozzles.

4. The device in accordance with claim 3, wherein the guide track segments comprise extruded sections, whose wall sections, which border the sliding surface of the guide track, form an upstream nozzle wall and the downstream nozzle wail, in relation to the conveying direction, at two successive nozzles.

5. The device in accordance with claim 2, further comprising a common pressure chamber connected with the plurality of nozzles.

6. A device for creating a spread-out stream of tobacco fibers, the device receiving tobacco from an inlet portion and supplying tobacco to an outlet portion, comprising:

a concave curved guide track along with the fiber stream of tobacco fibers are conveyed, the guide track having a sliding surface extending from the inlet portion to the outlet portion, the sliding surface being formed with a generatrix based on a uniform curve; and at least one air nozzle having an air flow opening interrupting the sliding surface so that air exiting the nuzzle acts in a conveyance direction of the fiber stream for spreading out the tobacco fibers, wherein the nozzle has a downstream wall, in relation to the conveyance direction of the fiber stream, which makes a transition into the concave-curve guide track in a steady convex curvature such that air exiting the nozzle achieves the Coanda effect.

7. The device of claim 6, wherein the guide track comprises discrete guide track elements.

8. The device of claim 7, wherein the nozzle has an upstream wall and the guide track has a width, wherein adjacent guide track elements define the upstream and downstream walls of the nozzle, the nozzle being continuous over the width of the guide track.

9. A device for creating a spread-out stream for tobacco fibers, comprising:

a concave-curved guide track along which the fiber stream of tobacco fibers are conveyed, the guide track having a generatrix based on a uniform curve, a portion of the concave-curved guide track being formed by a convex sliding surface: and at least one air nozzle haying an au flow opening interrupting the guide track so that air exiting nozzle acts in a conveyance direction of the fiber stream for spreading out the tobacco fibers, wherein the nozzle has a downstream wall, in relation to the conveyance direction of the fiber stream, which makes a transition into the guide track in a steady convex curvature such that air exiting the nozzle achieves a Coanda effect.

10. The device in accordance with claim 9, wherein the guide track has a width, and the at least one nozzle terminates in the sliding surface and extends continuously over the width of the guide track.

* * * * *